US005532680A

United States Patent [19]

Ousborne

[11] Patent Number: 5,532,680

[45] Date of Patent: Jul. 2, 1996

[54] AUTOMATIC MESSAGE PLAYBACK SYSTEM

[76] Inventor: Jeffrey Ousborne, 5606 Foxview Ct., Clarksville, Md. 21029

[21] Appl. No.: 411,332

[22] Filed: Mar. 27, 1995

[51] Int. Cl.[6] ..... G08B 13/18

[52] U.S. Cl. ..... 340/567; 340/505; 340/552; 340/692; 360/12; 369/69

[58] Field of Search ..... 340/692, 541, 340/567, 565; 250/221, 222.1; 360/12, 69; 369/19, 20, 22, 24, 69, 53, 57

[56] References Cited

U.S. PATENT DOCUMENTS

| | | | |
|---|---|---|---|
| 3,861,792 | 1/1975 | Donati | 353/15 |
| 4,275,274 | 6/1981 | English | 340/692 |
| 4,318,089 | 3/1982 | Frankel et al. | 340/567 |
| 4,745,284 | 5/1988 | Masuda et al. | 340/567 |
| 4,912,457 | 3/1990 | Ladd | 340/692 |
| 4,951,822 | 8/1990 | Knapp et al. | 340/692 |
| 4,988,980 | 1/1991 | Graham | 340/679 |
| 5,264,822 | 11/1993 | Vogelman et al. | 340/692 |
| 5,293,155 | 3/1994 | Nicol et al. | 340/692 |
| 5,369,269 | 11/1994 | Fukuda et al. | 250/221 |

*Primary Examiner*—John K. Peng
*Assistant Examiner*—Benjamin C. Lee
*Attorney, Agent, or Firm*—Morton J. Rosenberg; David I. Klein

[57] ABSTRACT

An automatically actuated voice message delivery system is provided. At least one motion sensor (40) and one or more optional presence detectors (45) are strategically placed within an enclosed area so as to monitor delineated zones thereof for entering individuals. When an entering individual is detected by one of the sensors (40) or detectors (45), a pre-recorded voice message pertaining to the entered zone is automatically delivered to that individual. When the entering individual exits a given zone and subsequently enters a different zone, delivery of the pre-recorded voice message pertaining to that zone is triggered by the monitoring sensor (40) or detector (45) thereof. A plurality of logically related messages may thereby be progressively delivered as an individual makes his or her way through an enclosed area monitored by the subject automatic message delivery system.

18 Claims, 5 Drawing Sheets

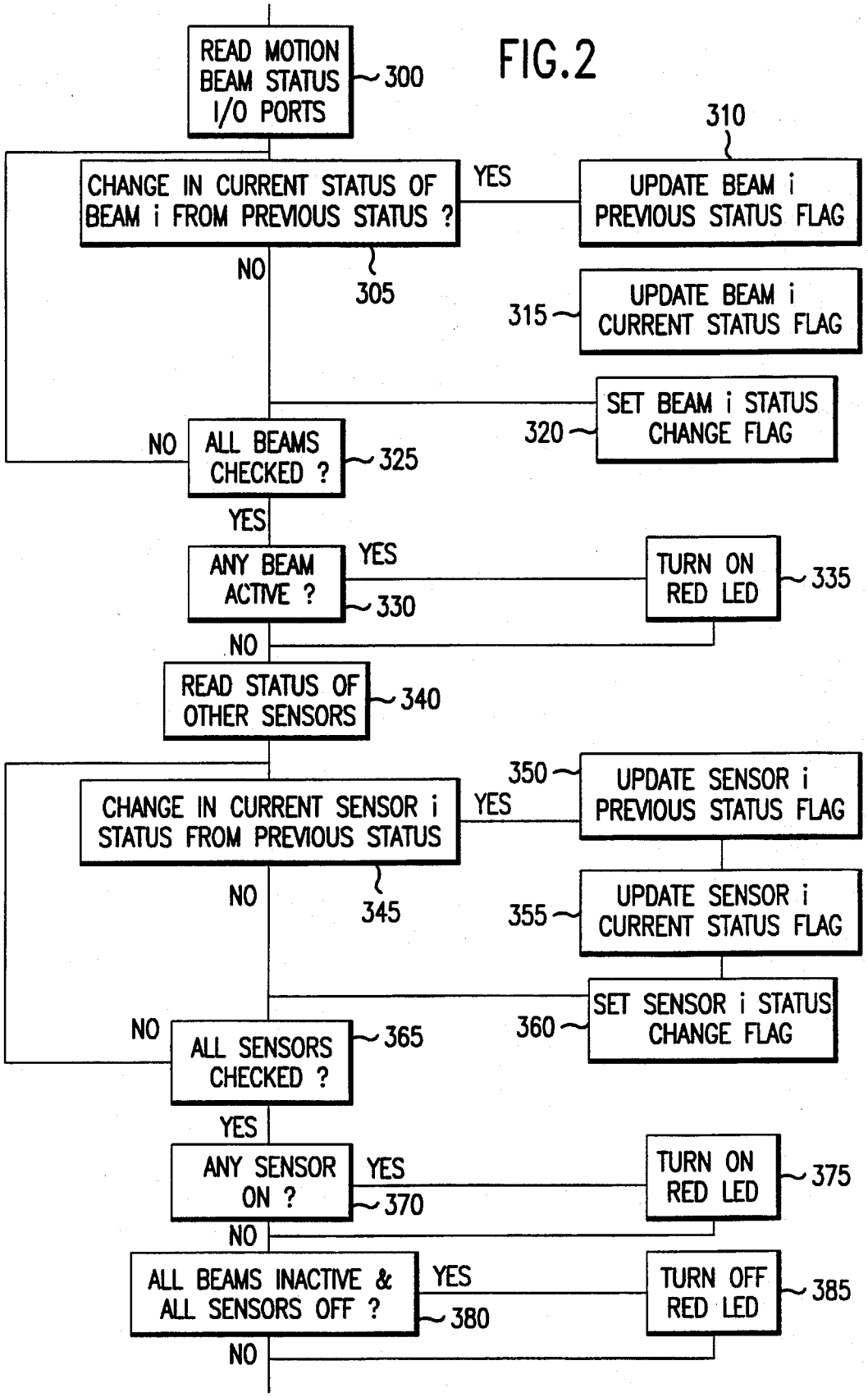
FIG.2
READ MOTION BEAM STATUS I/O PORTS
300
CHANGE IN CURRENT STATUS OF BEAM i FROM PREVIOUS STATUS ?
305
YES
NO
310
UPDATE BEAM i PREVIOUS STATUS FLAG
315
UPDATE BEAM i CURRENT STATUS FLAG
320
SET BEAM i STATUS CHANGE FLAG
ALL BEAMS CHECKED ?
325
NO
YES
ANY BEAM ACTIVE ?
330
YES
NO
TURN ON RED LED
335
READ STATUS OF OTHER SENSORS
340
CHANGE IN CURRENT SENSOR i STATUS FROM PREVIOUS STATUS
345
YES
NO
350
UPDATE SENSOR i PREVIOUS STATUS FLAG
355
UPDATE SENSOR i CURRENT STATUS FLAG
360
SET SENSOR i STATUS CHANGE FLAG
ALL SENSORS CHECKED ?
365
NO
YES
ANY SENSOR ON ?
370
YES
NO
TURN ON RED LED
375
ALL BEAMS INACTIVE & ALL SENSORS OFF ?
380
YES
NO
TURN OFF RED LED
385

AUTOMATIC MESSAGE PLAYBACK SYSTEM

BACKGROUND OF THE INVENTION

Field of the Invention

The subject automatic message playback system is broadly directed to an automatically actuated voice message delivery system. More specifically, the subject automatic message playback system is a system which monitors an enclosed area for an entrant thereof and audibly transmits to a detected entrant one or more of those stored messages when the proximity and/or movement of the entrant satisfies triggering parametric conditions corresponding to that message. The system effectively monitors the movements of a detected entrant while monitoring for new entrants in order that a plurality of messages may be progressively and appropriately delivered to a given occupant responsive to that occupant's continued movements through an enclosed area.

It is desirable in many real property marketing situations, though not practical, to have at all times available a salesperson to guide potential customers through a tour of the property being marketed. Often, the identification and explanation of desirable features not otherwise apparent to a casual observer will mean the difference between a sale or no sale of that property. It is nevertheless the practice, in model home parks for example, to allow potential customers to tour the model homes without any guidance. The ongoing costs of maintaining a competent salesperson on site dedicated for this purpose preclude such as a feasible option for many developers and real estate brokerage agencies. It would therefore be desirable to such developers and real estate agencies to have in place within their market properties an automated system which provides progressive tour guidance for potential customers much like a salesperson would provide.

PRIOR ART

Automatically actuated systems triggered by detection of various physical parameters, including systems directed to audio message delivery, are known in the art. The best prior art known to Applicant includes: U.S. Pat. Nos. 5,032,716; 4,185,192; 5,142,199; 4,307,859; 5,161,199; 5,073,706; 5,017,770; 4,984,098; 3,861,792; 5,198,799; 4,988,980; 4,334,248; 4,544,920; 4,100,581; 4,870,687. Such known automatically actuated audio message delivery systems, however, deliver the same message each time a detection is made of an entrant in its field of view. Progressive delivery of a series of appropriate messages to potential customers as they tour a market property is not possible with those systems in the absence of extensive retrofitting or redesign. Moreover, delivery of all information in a single lengthy message, though possible with those existing systems, would be of limited value as many potential customers forget, or in frustration, ignore information so provided. Hence, there is no automatically actuated audio message delivery system heretofore known which comprehensively monitors an enclosed area and progressively delivers within that enclosed area, responsive to an entrant's passage therethrough, audio messages tailored to specific discrete zones and/or to the detected entrant's direction of travel.

U.S. Pat. No. 5,032,716, for instance, is directed to a supermarket advertising device which automatically delivers an audio message to an approaching shopper. The shelf-installed system there monitors optical reflections off a metallic rear wall portion of a product shelf to detect the approach of a shopper. When an approaching shopper is so detected, a voice message promoting the product displayed on that shelf is delivered to the shopper. There is no provision in that system, however, for progressive delivery of a plurality of voice messages depending on the movements of the detected shopper within that system's field of view.

U.S. Pat. No. 5,142,199 is directed to a room lighting system wherein an infrared light switch controls the actuation of each light in an array of overhead lights. Depending on the location of an occupant within a room, as determined by detections of that occupant's infrared emissions, only those overhead lights necessary for sufficient lighting of the area immediately occupied by the occupant within the room are actuated. Although actuation which depends on the movements of an enclosed area occupant occurs in that system, no messages, much less voice messages, are delivered therein, as they are in the subject automatic message playback system.

U.S. Pat. No. 4,307,859 is directed to a message announcement system which automatically announces the appropriate one of a number of possible voice messages. That system has in place a plurality of railroad track-mounted sensors which sense when a train passes certain check points and, upon a train's passage of each check point, generates a custom message by sequentially arranging and delivering at the stationhouse a combination of message segments retrieved from a library of stored segments. Although it effects delivery of a plurality of messages based on differing sensed conditions, that system does not conduct comprehensive monitoring of an enclosed area for detection of those to whom a voice message is to be delivered, as does the subject automatic message playback system. Furthermore, that system does not continually monitor the movements of the initially detected subject for the progressive delivery of further messages responsive thereto.

The subject automatic message playback system overcomes these shortcomings by automatically and progressively providing for potential customers a plurality of concise voice messages as they tour a market property. As a potential customer enters a particular room or area of the market property, the voice message pertaining to that room or area is delivered to him or her. The message may highlight and detail certain features peculiar to specific regions of that room or area, then, as the potential customer leaves the room, either begin describing the room or area to which that potential customer is heading or begin suggesting the next room or area for the potential customer to tour. As the potential customer enters the next room or area, the voice message pertaining to that room or area, and/or to the potential customer's direction of travel, is delivered. The potential customer is thereby guided through a thorough and informative tour of the market property without being inundated at any one time with annoying verbiage.

BRIEF DESCRIPTION OF THE DRAWINGS

FIG. 2 is a functional flow block diagram of the preferred embodiment of the motion and presence detection function of the subject automatic message playback system;

DETAILED DESCRIPTION OF THE PREFERRED EMBODIMENT

Figure 1:
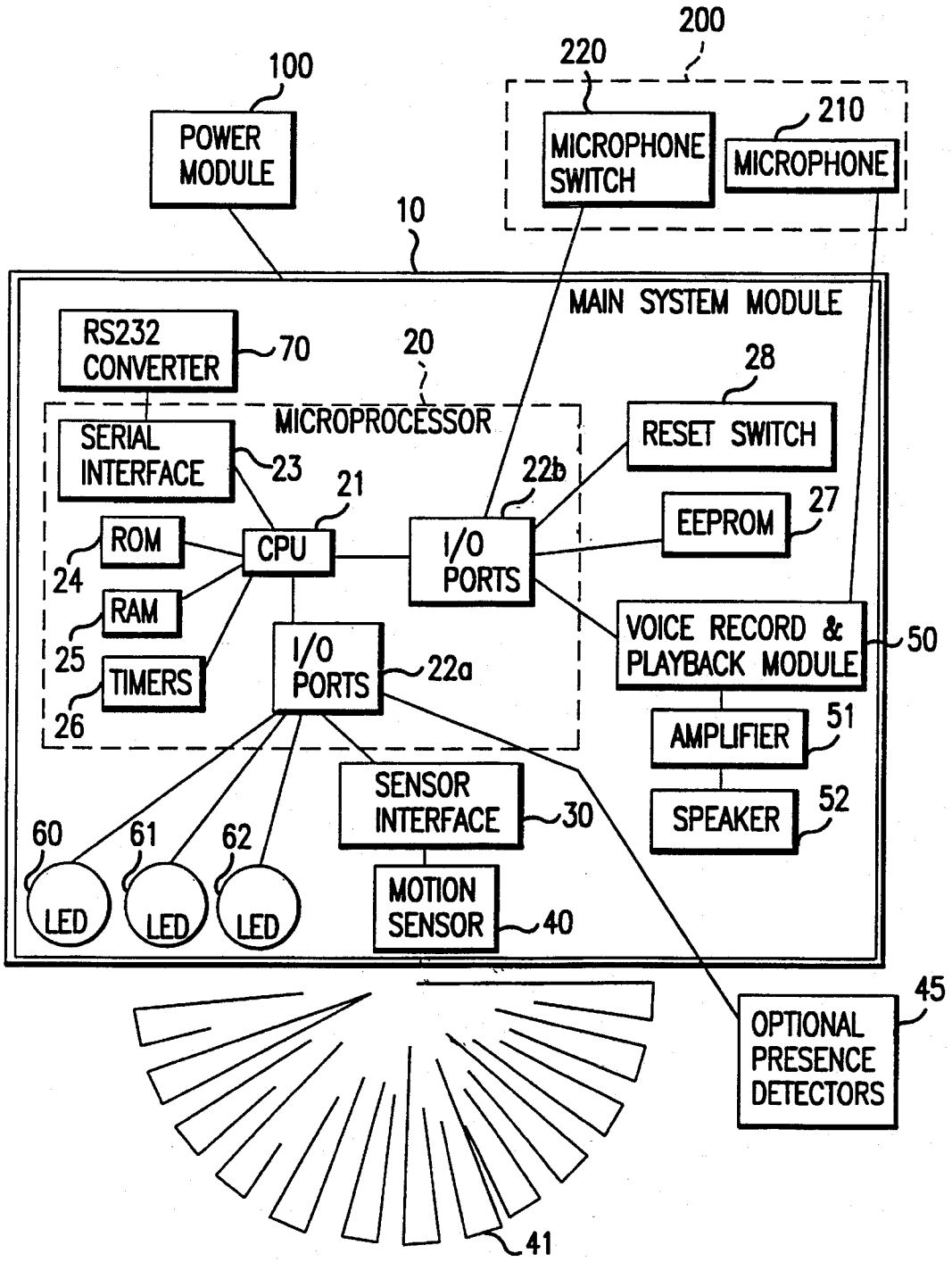
FIG. 1 is a block diagram showing the major functional components of the subject automatic message playback system.

Referring now to FIG. 1, the subject automatic audio message playback system generally includes a main system module 10, a power supply module 100, a microphone assembly 200, a motion sensor 40 (incorporated as part of main system module 10 in the configuration shown), a plurality of optional presence detectors 45, and software to be described in paragraphs to follow for system control and data processing. Main system module 10 is preferably a modularly encased unit to be coupled to an available 120 VAC electric power source through DC power supply module 100 and placed in an enclosed area. Although the inclusion of a motion sensor 40, alone, is sufficient for operation of the subject automatic audio message playback system, main system module 10 is preferably equipped with a motion sensor 40 and at least one optional presence detector 45 which, together, monitor the zones of a given enclosed area for entrants and periodically pass to main system module 40 detection parameter data for system processing. Prior to or during operation, a plurality of voice messages are recorded onto main system module 10 such that when an entrant is detected in a delineated zone with a specific direction of travel within that enclosed area, the appropriate one of the messages pertaining to that particular zone is retrieved and audibly delivered to the detected entrant.

Main system module 10 contains a microprocessor 20 having ROM 24, RAM 25, I/O ports 22*a*, 22*b*, serial interface 23, and various timers 26, all coupled to CPU 21 which serves as the processing engine for the subject automatic audio message playback system. Microprocessor 20 is preferably a standard microprocessor chip such as the Phillips 8X524 or other comparable chip commercially available. It holds as firmware stored in ROM 24 software for operation of all system components and control of data passage therebetween, as well as software for processing the enclosed area entrant detection parameter data provided by motion sensor 40 and each of the presence detectors 45 through I/O ports 22*a*.

Driven by this firmware, CPU 21 processes the collected detection parameter data in light of the system configuration database customized for a given application and stored in EEPROM 27, a standard nonvolatile storage device external to microprocessor 20 coupled thereto through I/O ports 22*b*. If system operation is to be modified, or if a presently functioning system is to be deployed in a different enclosed area, the system configuration database may be reconfigured by coupling an external processor to microprocessor 20 through serial interface 23 and RS232 converter 70 and thereby reassigning the values of such system parameters as message activation flags and message location table entries.

The timers 26 of microprocessor 20 generate interrupts during system operation to precisely control timed events in order that audio messages, timely both in sequence and duration, may be played back to entrants of an enclosed area as they move progressively through the delineated zones. Among the timed events controlled by timers 26 are the sampling rate of motion sensor 40 and the durations of record and playback which, preferably, may be between five seconds to as long as message storage capabilities will allow.

The motion sensor 40, preferably incorporated as a component of main system module 10, comprises at least one passive infrared piezoelectric film suitably arranged and affixed within main system module 10. One type of such piezoelectric film is the AMP PIRL film. Such films sense infrared, or heat, emissions from subjects within their fields of view. Typically, they are formed in an arcuate shape extending approximately 180 degrees such that a plurality of discrete, non-overlapping sensing regions, through which infrared emissions are sensed. These sensing regions may be metaphorically referred to as "beams" 41, which, as shown define a semi-circular field of view. The infrared emission sensed in each beam 41 maps to a unique bit of the detection parameter data word generated by motion sensor 40 and ultimately passed to microprocessor 21 through I/O ports 22*a*. When an individual enters the field of view of motion sensor 40, that individual "breaks" a beam 41 whereby a rapid increase in temperature is sensed along that beam 41, causing the digital detection parameter bit corresponding to that particular beam 41 to be set high from its normally low state. As the detected individual continues to pass through the field of view, the state of each of the digital detection parameter bits corresponding to the beams 41 sequentially "broken" by the individual transition from low to high, then back to low. The resulting digital detection parameter data word is then sampled at a sufficient rate to extrapolate therefrom the speed and heading of the individual's movement through the sensor's field of view.

The analog output of the motion sensor 40 is conditioned and converted to the digital detection parameter data word discussed above by a sensor interface circuit 30. Incorporated in sensor interface circuit 30 are suitable means for signal gain control, signal filtering, and digital quantification level (threshold) adjustment. The filtering means is preferably a passive high pass filter having a time constant of approximately one (1) minute. Such means effectively removes signal fluctuations due to slowly varying temperatures. As the natural body temperature of an individual is high relative to the ambient air in typical applications, that individual's entry into the field of view of motions sensor 40 will cause only rapid fluctuations in the sensed temperature. The high pass filter, therefore, serves as an ambient air temperature compensation level adjustment means.

The threshold adjustment means controls the amplitude level of an analog output signal generated by motion sensor 40 at which the state of the corresponding digital bit transitions from low to high. This threshold adjustment means thus effectively controls the operational range of motion sensor 40.

In addition to the motion sensor 40, one or more presence detectors 45 may be incorporated into the subject automatic message playback system to expand the functional coverage thereof. Such detectors 45 may be any one of many commercially available types, including active optical beam interruption detectors, passive photosensors, and pressure sensing strain gauges. When incorporated, such detectors 45 are coupled to microprocessor 20 through the I/O ports 22*a* respectively dedicated for them.

Referring to the voice record and playback module 50, such is coupled to microprocessor 20 through I/O ports 22*b*.

This voice device 50 is preferably a commercially available chip such as the ISD2590 which stores in a solid state medium up to 90 seconds of audio messages. Address and control lines extending from the voice device 50 are accessed by microprocessor 20 to exert digital control over the message partitioning, record, and playback functions of that device 50. The voice device 50 has in place a microphone jack for the coupling thereto of a microphone assembly 200 comprising a microphone 210 and microphone switch 220, and through which a user may directly record onto device 50 a plurality of voice messages. The voice device 50 also has in place internal amplification and automatic gain control means to suitably condition the audio signals during such recordation. Note that microphone on/off switch 220 is directly coupled to I/O ports 22*b* of microprocessor 20 in order that microprocessor 20 may control the recordation process.

Voice device 50 is coupled to an audio amplifier 51 and speaker 52 for audible delivery of voice messages as commanded by microprocessor 20. The speaker 52 may be any one of the many commercially available audio speakers having electrical and mechanical specifications suitable for a given application of the subject automatic message playback system. The audio amplifier 51 is preferably a National LM2877 or other commercially available amplifier comparable in its specifications to that unit and having variable gain control.

So that moving parts are eliminated, and overall system reliability thereby enhanced, the audio messages recorded onto voice module 50 are stored in digital form on a solid state data memory device. The recorded messages are stored in fixed blocks of time, preferably in two second blocks. Since these messages may consist of more than one block of time, a message location table which catalogs for each recorded message its constituent time blocks is maintained in EEPROM 27 as part of the system configuration data base and updated when necessary through means to be described in later paragraphs. During playback of a message, microprocessor 20 consults the message location table for the string of indices pertaining to the message blocks which combine to form that particular message. Microprocessor 20 then sequentially retrieves and causes to be transmitted by speaker 52 each of the message blocks constituting that message.

When a new audio message is to be recorded, that message is recorded in as many unused audio blocks as is necessary to hold that message. As a consequence, a message will not necessarily be contiguously contained in adjacent message memory blocks after repeated cycles of message deletions and recordations have occurred. Nevertheless, efficient utilization of the available message storage capacity is thereby achieved.

Turning now to the software programmed into microprocessor 20 as firmware resident in ROM 24, such generally controls five functions: the system power-up sequence; enclosed area monitoring; detection processing; message delivery; and, message recording. The power-up sequence is invoked each time the subject automatic audio message playback system is powered up for operation. That sequence includes a software initialization procedure whereby all temporary system operation parameters such as the prior and current status flags for motion sensor 40 and presence detectors 45, various status change flags, and message playback status flags are cleared and reset. The sequence also includes a system integrity check procedure whereby the operational status of EEPROM 27 is checked. If the check indicates a failure, all system configuration parameters stored and read from EEPROM 27 such as the message activation flags and the message location table entries are reset to their default values, if at least a default message is available. Otherwise, the red and blue light emitting diodes (LED) 60, 62 are flashed at a predetermined interval as an indication to the user that new messages must be recorded. If the EEPROM 27 status check passes and previously recorded messages currently exist, the green and blue LEDs 61, 62 are flashed for a predetermined duration as an indication to the user that such is the case. Following this procedure, the microprocessor timers 26 are set and the time interrupts associated therewith are enabled.

Referring now to FIG. 2, there is shown a functional flow diagram of the motion and presence detection program loop. This program which is executed once each time an interrupt from the first of timers 26 (timer 1 interrupt) of microprocessor 20 occurs monitors the operation of motion sensor 40 and presence detectors 45 (FIG. 1). As shown in flow block 300, the I/O ports dedicated to receiving motion sensor beam 41 signals are first read. The state of each digital bit signal corresponding to a beam 41 is iteratively compared in flow block 305 to its previous state to determine if any changes in signal state have occurred. If so, the state change flag for that bit is set in flow block 320 after the previous status and current status flags for that bit are updated in flow blocks 310, 315. This iteration continues until all bit signals corresponding to beams 41 are checked. If a state change from low to high has occurred in any of the bit signals so checked, the red LED 60 is turned on to indicate that a beam 41 is active, as shown in flow blocks 330, 335. If other sensors 40 or detectors 45 are connected to the system, as determined in flow block 340, the iterative bit signal checks described above are performed for each of those other sensors 40 or detectors 45 in flow blocks 345–365. If, after all sensors 40 or detectors 45 have been so checked, any detections, or bit signal state changes from low to high, have occurred as determined in flow block 370; the red LED 60 is turned on in block 375 to indicate to the user that such is the case. If it is determined in flow block 370 that no detection has occurred, and that no sensor is therefore on, such is confirmed in flow block 380 and the red LED 60 is turned off, if necessary, in flow block 385.

Figure 3:
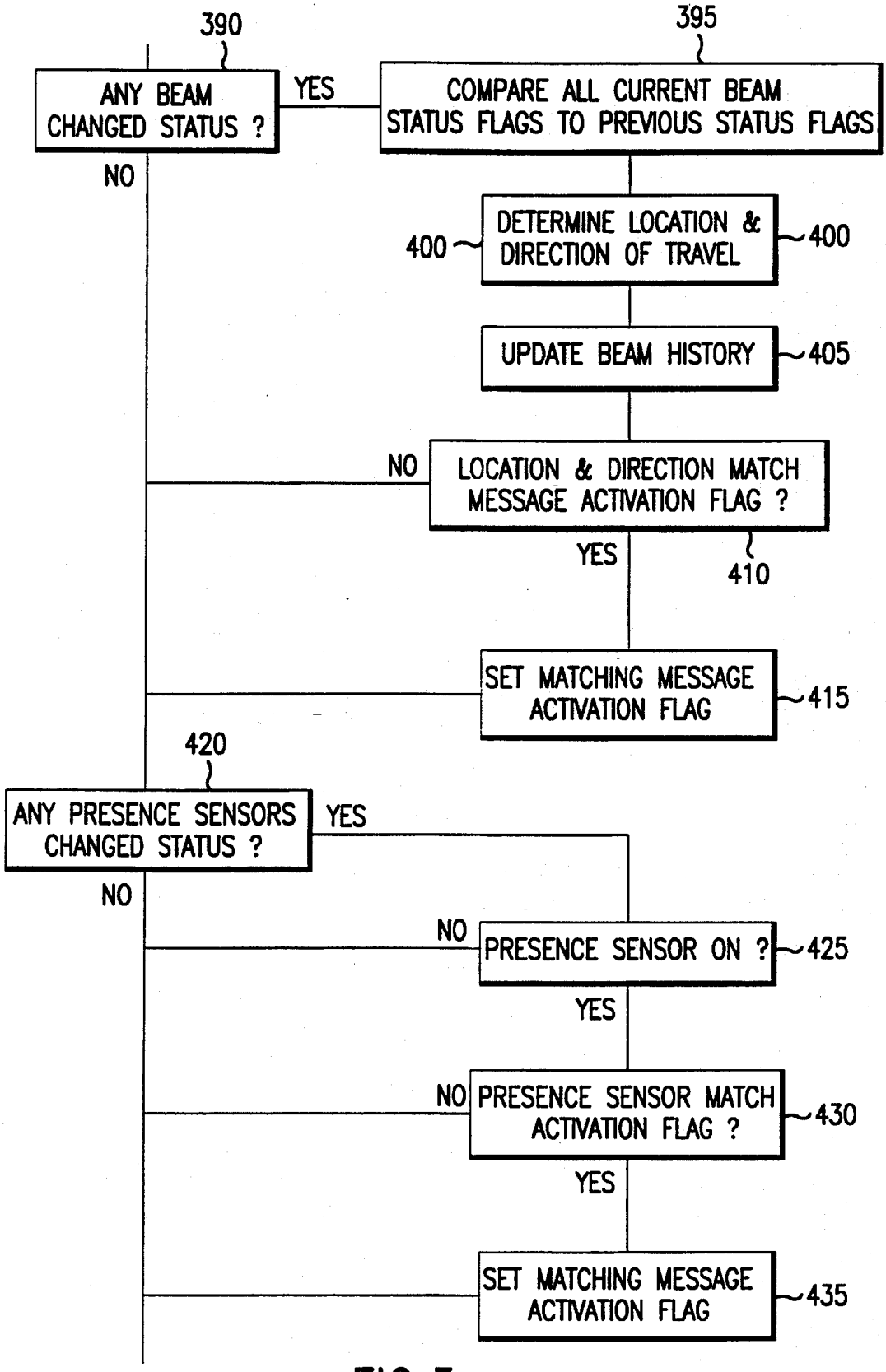
FIG. 3 is a functional flow block diagram of the preferred embodiment of the detection processing and message identification function of the subject automatic message playback system.

If execution of the motion and presence detection program loop of FIG. 2 indicates a detection, the full detection processing and message identification program loop functionally diagrammed in FIG. 3 is executed. As shown, a determination is initially made in flow block 390 as to whether or not any bit signal corresponding to a beam 41 of a motion sensor 40 has changed in its signal state. If so, the appropriate message to be played back is identified in flow blocks 395–415. First, the current and previous status flags of all beams 41 of a motion sensor 40 are compared to determine, in flow block 400, which of the beams 41 have been entered by an individual and from what direction that entry has been made. As a history of signal state changes is maintained for each beam 41 (a predetermined number of the most recent bit signal state changes), the detected individual's direction of travel may be accurately extrapolated by considering each beam's current status in light of its beam history. Where a bit signal state change has occurred, the beam history for that particular beam 41 is updated in flow block 405. The detected individual's location and direction of travel are compared in flow block 410 with those levels associated with the message activation flags set out in the system configuration data base. A match indicates that a suitable audio message for the computed location and direction of travel exists; and, in that case, the message activation flag identified by that match is set in flow block 415. The proper message is then flagged for playback.

After detection processing has thus occurred for each of the motion sensors 40 in the system, a determination is made in flow block 420 as to whether an output signal state change has occurred in any of the presence detectors 45. If so, an initial check is first made in flow block 425 to confirm that the state change is a positive one, indicating that an individual has entered the detector's field of view or has otherwise triggered its detection means. Following this confirmation, a search is made of the system configuration data base to identify the message activation flag matching the given presence detector 45. If a message activation flag has in fact been dedicated for the given presence detector 45, and such is identified in flow block 430, that matching message activation flag is set in flow block 435 to activate the proper message for playback.

Where more than one occupant is present in an enclosed area, a multiplicity of simultaneous detections from different monitored zones of that enclosed area sufficient to cause message selection conflicts is conceivable. In such cases, the system simply selects the message activation cue corresponding to a selected default message and proceeds, accordingly, to the message playback procedure.

Figure 4:
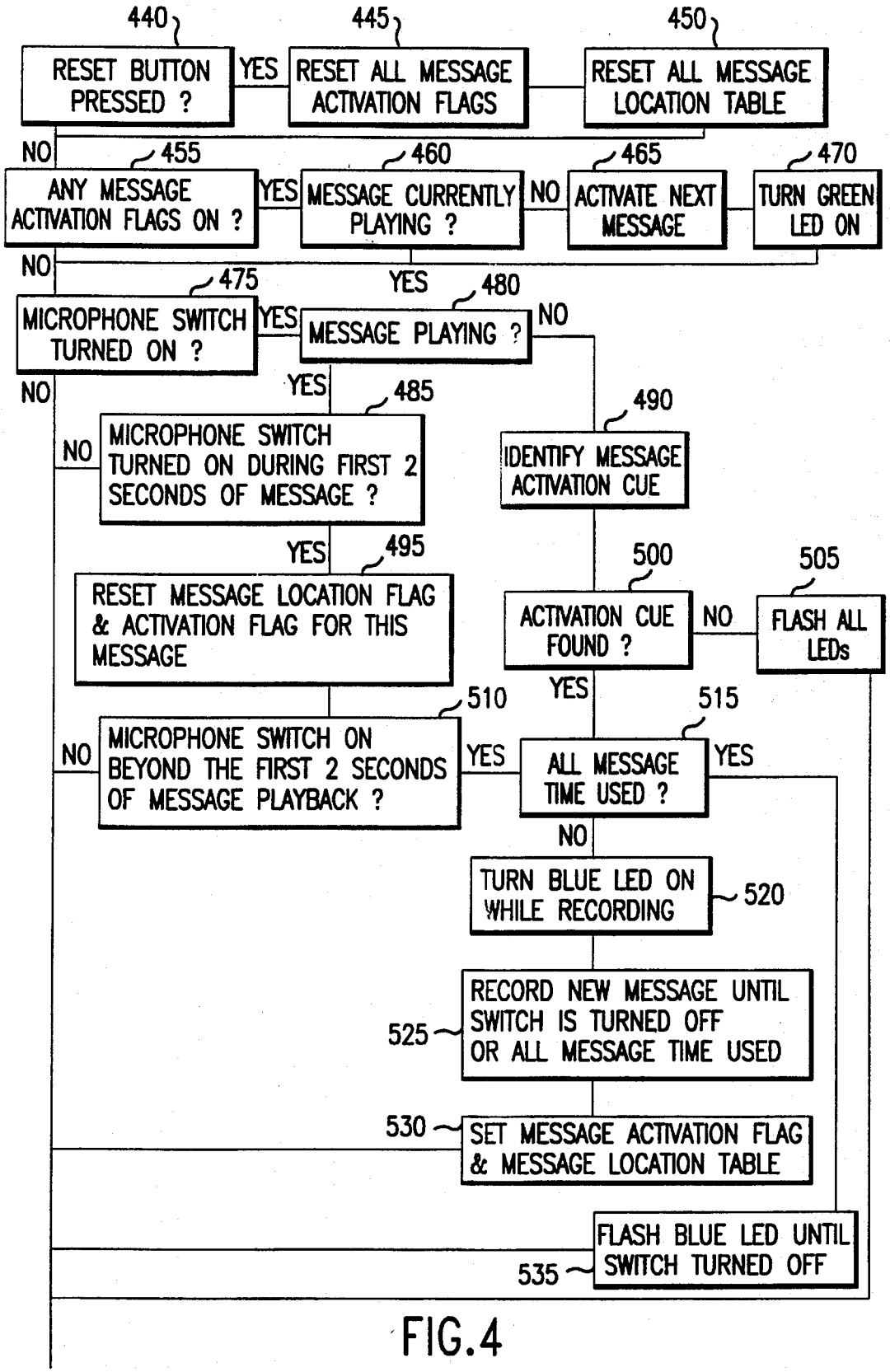
FIG. 4 is a functional flow block diagram of the preferred embodiment of the message playback and recordation functions of the subject automatic message playback system; and, FIG. 4A is a functional flow block diagram of the priority message selection function in an alternate embodiment of the message playback function of the subject automatic message playback system.

Referring now to FIG. 4, there is shown the functional flow diagram illustrating the audio message playback and recording procedure which is executed after a second one of the timers 26 (FIG. 1) generates an interrupt signal (timer 2 interrupt). Initially, the status of the message reset switch 28 is checked in flow block 440; and, if the switch 28 has been set, the message activation flags and the message location table entries contained in the system configuration data base are reset in flow blocks 445, 450. The operational flow then proceeds to flow block 455 where the existing message activation flags are checked to determine if any audio messages have been placed in the queue for playback. If so, the message playback status flag is checked in flow block 460 to determine if a message is currently playing back. If no message is currently playing, immediate playback of the currently activated message proceeds in flow block 465. The green LED 61 is then turned on in flow block 470 to indicate that playback is occurring. Note that in the preferred embodiment, the green LED 61 remains on for the first two seconds of a message playback, then flashes thereafter for the remainder of the playback duration.

Figure 4A:
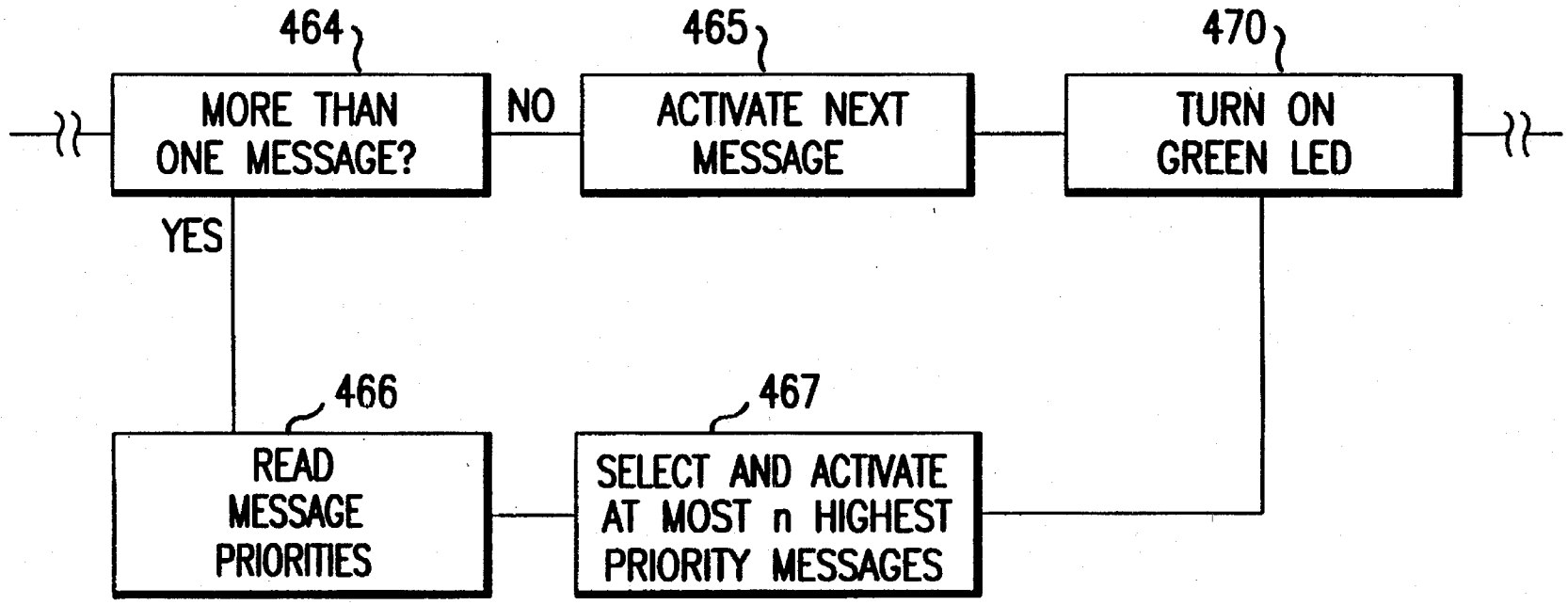

In an alternate embodiment of the message playback procedure, a message prioritization scheme would be implemented to guard against superfluous and ineffectual audio message delivery. As shown in FIG. 4A, such would include additional steps 464, 466–467 incorporated with the existing step 465 to check for those situations where more than one message is triggered within a predetermined time duration by, for instance, an occupant rapidly passing through a multiplicity of monitored zones within a given enclosed area. Each audio message stored in voice device 50 would have appended thereto dedicated priority designation bits. Given an indication from the check in flow block 464 that more than one message has been triggered as described above, the priority designation bits of those messages would be read in flow block 466. The number of triggered messages would then be compared with a predetermined number of messages n in flow block 467; and if the number of triggered messages exceeds n, only that preset number n of triggered messages having the highest priority are selected for playback. The flow then proceeds as before to flow block 470.

Referring back to FIG. 4, the flow proceeds from block 470 to flow block 475 where the status of the microphone switch 220 is checked. If the check indicates that the switch 220 is on, and it is also determined in flow block 480 that a message playback is in progress, the message location and activation flags for the currently playing message are reset so as to effectively erase that message from memory if, in block 485, it is determined that the microphone switch 220 had been turned on during the first two seconds of that message. If, as shown in flow block 510, the microphone switch 220 remains on beyond the first two seconds of the current message playback, recordation of a new message is commenced.

The discussion in the preceding paragraph relates generally to recordation of new replacement messages for which the message activation cues, or detection triggering parameters (location, direction of travel), already exist. Creation of new and original messages must be preceded by activation of each motion sensor 40 or presence detector 45 in the system to define for each new message its activation triggering cues or conditions. This process may be initiated by activating the appropriate sensor 40 or detector 45, subsequent to turning on the microphone switch 220, while no message activation flag remains set. Where a motion sensor 40 is involved, both detection beam location and the extrapolated direction of travel constitute the activation cue for a newly recorded message. Where a presence detector 45 is involved, the designation for the sensor itself is simply the message activation cue. In either case, the defined activation cue is assigned to the message thereafter recorded.

Referring back to the flow of FIG. 4, when flow block 480 indicates that no message playback is in progress although the microphone switch 220 is on, the message activation cue to be established for a new message is identified and located in the system configuration data base, as shown in flow blocks 490 and 500. If no matching message activation cue in the system configuration can be found, all the LEDs 60, 61, 62 are flashed in flow block 505 to indicate to the user that a sensor must first be activated to identify the message cue. If, however, a matching message activation cue is found, recordation of a new message commences without erasing any existing messages.

The new message recordation process commences at flow block 515 where the message storage capacity is checked for available space. If all available storage space has been consumed, the flow proceeds directly to flow block 535 where the blue LED 62 is flashed until microphone switch 220 is turned off. If message memory is available, the flow proceeds to flow blocks 520, 525 where the blue LED 62 is turned on, and a new message is recorded through microphone 210 until either the microphone switch 220 is turned off, or the available message memory has been consumed. Thereafter, the message activation flag and the message location table entry pertaining to the new message are assigned. These values are then stored in the system configuration data base once recording is concluded.

It should be noted that an external processor such as an IBM compatible PC or an Apple Macintosh computer may be coupled via RS232 converter 70 to the serial interface 23 of microprocessor 20 to reconfigure the subject automatic audio message playback system. Using system interfacing means programmed into that processor, a user may record, clear, and play any audio message in the system. Also, the activation cues for any audio message may be set directly without having to physically activate the corresponding sensor or detector simply by selecting from menu options on the external processor the detection location and direction of travel or presence detector designation, whichever is applicable. Although audio messages, either previously recorded and converted into digital form or artificially generated using a voice synthesizer, may be passed directly from the external processor to the microprocessor 20; the preferred embodiment employs, for simplicity, the new message record sequence, such as shown in flow blocks 515–530 of FIG. 4, whereby an audio message is recorded through microphone 210.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular combinations of system control or system data processing steps may be reversed or interposed, all without departing from the spirit or scope of the invention as defined in the appended Claims.

What is claimed is:

1. An automatic message playback system having a system operation of transmitting audio messages responsive to detection of an enclosed area occupant comprising:

a) one or more occupant sensors for monitoring at least a portion of said enclosed area to parametrically detect the position of the enclosed area occupant, each of said one or more occupant sensors transducing an occupant detection parameter thereby sensed to a respective electrical signal representative thereof, at least one of said one or more occupant sensors having a plurality of discrete sensing fields of view and being actuated to generate a respective electrical signal for each of said plurality of sensing fields of view detecting the occupant therein;

b) system processor means having a control data storage medium coupled to said one or more occupant sensors for controlling said message playback system operation, said system processor means receiving from each of said one or more occupant sensors said respective electrical signals for automatically actuating audible transmission of one or more respective audio messages to said occupant responsive to said respective electrical signals, whereby said system processor means determines a migration of the occupant within said enclosed area from said respective electrical signals and generating message transmission signals for actuating transmission of respective one or more of said audio messages to the occupant responsive to said respective electrical signals generated by migration of the occupant within said enclosed area, said system processor means including means for prioritizing said audio messages stored in said control data storage medium and means for selecting a predetermined number of prioritized ones of said audio messages to respectively generate therefor said message transmission signals when the rate of said migration of the occupant within said enclosed area detected by said one or more occupant sensors exceeds a predetermined rate;

c) an erasable solid state message storage medium coupled to said system processor for storing in digital form said audio messages; and, d) a message transducing unit coupled to both said system processor means and said solid state storage medium, said message transducing unit having first audio transducing means for converting a message generated by a user in audio form to said digital form, said message transducing unit further having second audio transducing means for converting to said audio form said message retrieved in said digital form from said solid state message storage medium for said audible transmission thereof responsive to said message transmission signals from said system processor means.

2. An automatic message playback system having a system operation of transmitting audio messages responsive to detection of an enclosed area occupant comprising:

(a) one or more occupant sensors for monitoring at least a portion of said enclosed area to parametrically detect the enclosed area occupant, each of said one or more occupant sensors transducing an occupant detection parameter thereby sensed to respective electrical signal representative thereof, at least one of said one or more occupant sensors being a motion sensor having a plurality of discrete sensing fields of view and being actuated to generate a respective electrical signal for each of said plurality of sensing fields of view detecting the occupant therein;

(b) system processor means having a data storage medium coupled to said one or more occupant sensors for periodically storing a digital representation of a state of each said electrical signal to establish a signal history therefor and controlling said message playback system operation, said system processor means including (1) means for determining the occupant's position and at least one migration parameter within said enclosed area from said electrical signal and said signal history, and (2) means for automatically actuating audible transmission of one or more respective audio messages to said occupant responsive to said determined occupant's position and said at least one migration parameter representing a migration direction corresponding to first and second predetermined activation cues;

(c) an erasable solid state message storage medium coupled to said system processor for storing in digital form said audio messages; and, (d) a message transducing unit coupled to both said system processor means and said solid state storage medium, said message transducing unit having first audio transducing means for converting a message generated by a user in audio form to said digital form, said message transducing unit further having second audio transducing means for converting to said audio form said message retrieved in said digital form from said solid state message storage medium for said audible transmission thereof responsive to said message transmission signals from said system processor means.

3. The automatic message playback system as recited in claim 2 where said system processor means includes a plurality of system operational status indicating lamps.

4. The automatic message playback system as recited in claim 2 where said data storage medium of said system processor means is a nonvolatile erasable memory device.

5. The automatic message playback system as recited in claim 2 where an additional one of said one or more occupant sensors is an electromagnetic proximity sensor.

6. The automatic message playback system as recited in claim 2 where an additional one of said one or more occupant sensors is a pressure sensor.

7. The automatic message playback system as recited in claim 2 where an additional one of said one or more occupant sensors is an optical sensor.

8. The automatic message playback system as recited in claim 2 where said first audio transducing means includes a microphone coupled to said message transducing unit.

9. The automatic message playback system as recited in claim 2 where said automatic message playback system includes means for coupling to said solid state message storage medium a message encoding means for passage therefrom at least one replacement audio message in said digital form for storage in said solid state message storage medium, whereby an existing one of said audio messages stored on said solid state message storage medium is replaced by said replacement audio message in said digital form.

10. The automatic message playback system as recited in claim 2 where said system processor means generates and passes to said message transducing unit one or more default message transmission signals when more than a predetermined number of occupants are simultaneously detected by said occupant sensors.

11. The automatic message playback system as recited in claim 2 where said means for automatically actuating audible transmission of one or more of said respective audio messages is further responsive to correspondence between a third activation cue and an additional migration parameter being indicative of a rate of migration of the occupant within said enclosed area.

12. The automatic message playback system as recited in claim 2 where said first audio transducing means includes a record switch and said system processor means includes means for storing said first and second predetermined activation cues responsive to manual actuation of said motion sensor subsequent to closure of said record switch.

13. The automatic message playback system as recited in claim 2 where said system processor means includes means for independently executing a message record mode, a message transmit mode, and an occupant activity monitoring mode of system operation.

14. The automatic message playback system as recited in claim 13 where said system processor means includes means for simultaneously executing said message transmit and said occupant activity monitoring modes of system operation.

15. The automatic message playback system as recited in claim 13 where said system processor means includes means for simultaneously executing said message record and said occupant activity monitoring modes of system operation for establishing said first and second activity cues.

16. The automatic message playback system as recited in claim 2 where said automatic message playback system includes processor coupling means for coupling to said system processor means a remote processor for bidirectionally transferring digital communication signals therebetween.

17. The automatic message playback system as recited in claim 16 where said processor coupling means includes means for reading from and downloading to said data storage medium automatic message playback system data responsive to digital command signals generated from said remote computer by a user thereof.

18. The automatic message playback system as recited in claim 16 where said system processor means includes means for storing on said data storage medium predetermined initial values for a delineated set of system parameters defining a system configuration database, and where said processor coupling means includes means for passing to said system processor a second predetermined value for at least one of said system parameters for reconfiguring said system configuration database in response to digital command signals from said remote computer by a user thereof.

* * * * *